US006991083B2

(12) United States Patent
Yoshioka et al.

(10) Patent No.: US 6,991,083 B2
(45) Date of Patent: Jan. 31, 2006

(54) BILL VALIDATOR

(75) Inventors: Yasuo Yoshioka, Motosu-gun (JP); Motoki Sugiyama, Yamagata (JP)

(73) Assignee: Matsushita Electric Industrial Co., Ltd., (JP)

( * ) Notice: Subject to any disclaimer, the term of this patent is extended or adjusted under 35 U.S.C. 154(b) by 244 days.

(21) Appl. No.: 10/617,364

(22) Filed: Jul. 11, 2003

(65) Prior Publication Data

US 2004/0011619 A1 Jan. 22, 2004

(30) Foreign Application Priority Data

Jul. 12, 2002 (JP) ..... 2002-203827

(51) Int. Cl.
*G07F 7/04* (2006.01)

(52) U.S. Cl. ..... 194/346; 194/344; 194/203

(58) Field of Classification Search ..... 194/344, 194/202, 203, 346, 349; 271/256
See application file for complete search history.

(56) References Cited

U.S. PATENT DOCUMENTS

| | | | | |
|---|---|---|---|---|
| 4,348,656 | A | 9/1982 | Gorgone et al. | 340/146.3 |
| 4,513,439 | A | 4/1985 | Gorgone et al. | 382/7 |
| 5,242,041 | A | 9/1993 | Isobe | 194/207 |
| 5,325,952 | A | 7/1994 | McGinley et al. | 194/203 |
| 5,577,589 | A * | 11/1996 | Garcia Tinoco | 194/204 |
| 5,642,801 | A | 7/1997 | Burson, Jr. | 194/203 |
| 6,179,110 | B1 * | 1/2001 | Ohkawa et al. | 194/203 |

FOREIGN PATENT DOCUMENTS

EP 0 602 775 B1 11/1996

* cited by examiner

*Primary Examiner*—Donald P. Walsh
*Assistant Examiner*—Mark J. Beauchaine
(74) *Attorney, Agent, or Firm*—Steptoe & Johnson LLP

(57) ABSTRACT

The bill validator disclosed is provided with a plurality of pathway selectors at a position nearer to the inlet than the outlet, wherein the selectors select the pathways in respective different phases for the pathways to form a cross between the plurality of pathway selectors in every pathway selection.

11 Claims, 7 Drawing Sheets

FIG. 7A1
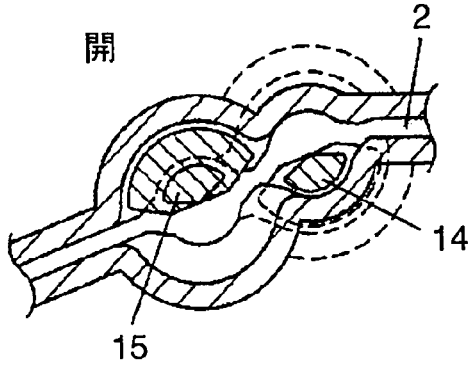
FIG. 7B1
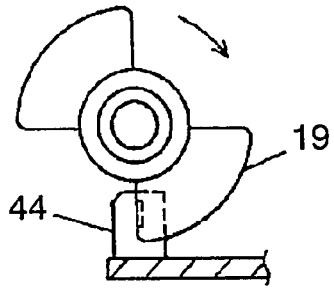
FIG. 7A2
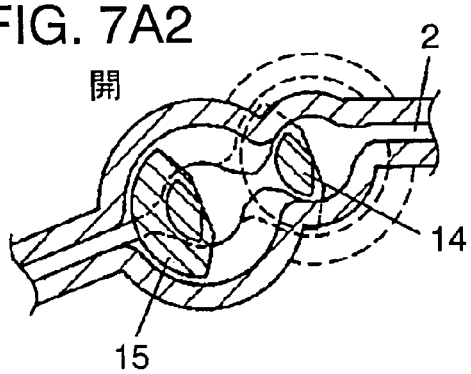
FIG. 7B2
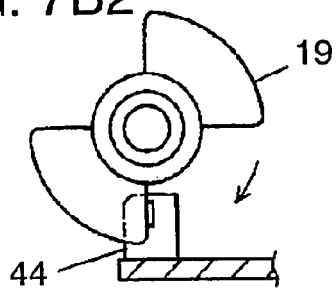
FIG. 7A3
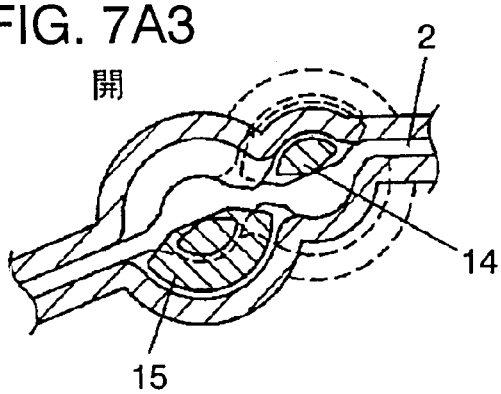
FIG. 7B3
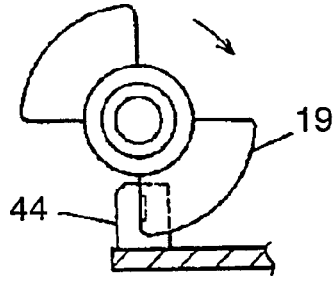
FIG. 7A4
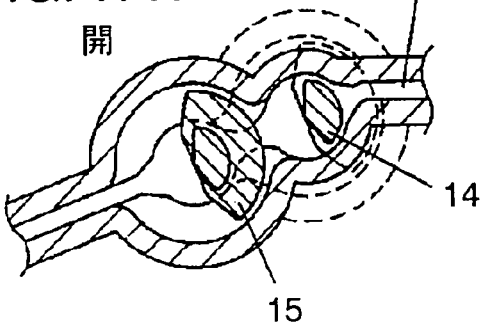
FIG. 7B4
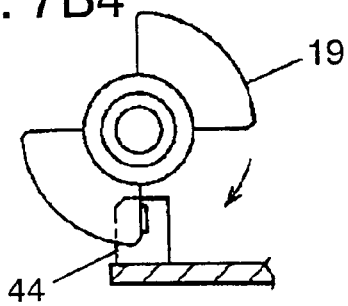

FIG. 8C1
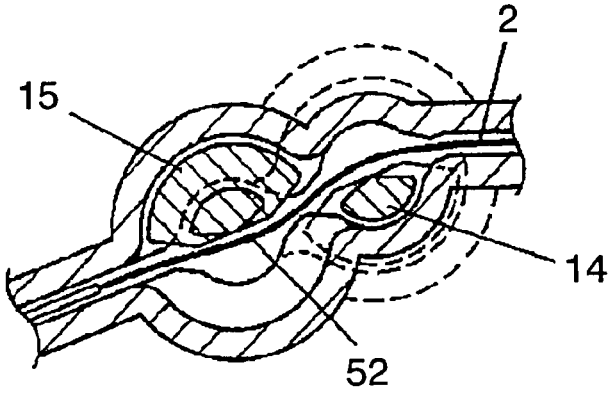
FIG. 8C2
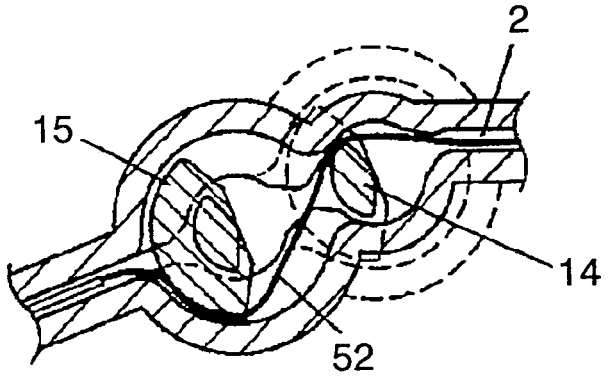
FIG. 8C3
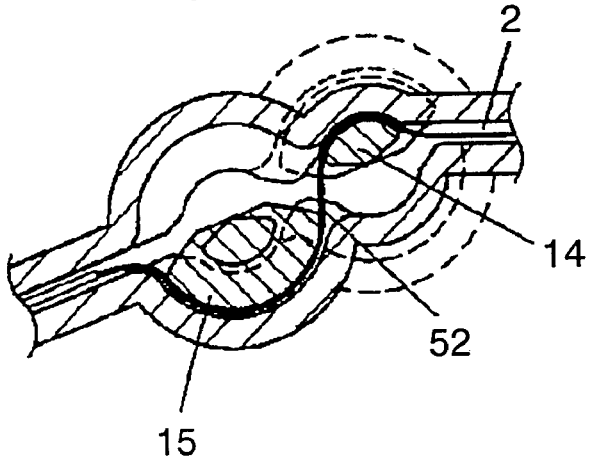

BILL VALIDATOR

FIELD OF THE INVENTION

The present invention relates to a bill validator for use in automatic vending machine or gaming machine for testing the validity of a bill.

BACKGROUND ART

Modernized automatic vending machine or gaming machine or the like capable of operating with a bill in addition to the previously known coin or token is increasing recently. Though these machines are equipped with bill validators, machines served in unattended environment must have functions to prevent various fraudulent or criminal activities other than validation/discrimination of paper currency.

A typical fraudulent activity is to retrieve a bill by pulling a string or a tape attached to the bill out of the machine after vending goods or services. To countermeasure such "stringing" activity a conventional bill validator is typically disposed with a block gate secured rotatably in a pathway to prevent bills from being retrieved.

Now, a conventional bill validator is described with reference to the drawings. FIG. 9 shows a cross-sectional view of a structure of a conventional bill validator. Bill inlet 1 is coupled to pathway 2 provided with first transportation portion 3 and second transportation portion 4 as shown. Rubber rollers are adopted for all of the transportation means in this example. Magnetic sensor 5 and first optical sensors 6*a* and 6*b* are mounted on pathway 2 for the bill validation. Outlet 7 is located at an end of pathway that extends to a bill storage box, and anti-stringing block 9 secured rotatably with respect to supporting point 8 on its one end while extends to the pathway on its another end is provided between validation portion 5, 6*a*, 6*b* and second transportation portion 4.

Now, movements of a conventional bill validator are described. A bill detector (not shown) disposed at inlet 1 detects a bill inserting, and sends signals to controller (not shown) to drive first transportation portion 3 and second transportation portion 4 to transport the bill along pathway 2. Scanning the bill to obtain test data during the transportation along pathway 2, magnetic sensor 5 and first optical sensor 6*a*, 6*b* compare the data with data of valid bills taken previously. If disagreed to accept first transportation portion 3 and second transportation portion 4 rotate in a reverse direction to return the bill to inlet 1, and if agreed the bill is forwarded further.

Leading edge of the bill transported to pathway 2 lifts anti-stringing block 9 and leave the situation kept unchanged until the rear edge of the bill passes anti-stringing block 9. Anti-stringing block 9 extends in pathway 2 after the rear edge of the bill has passed anti-stringing block 9 to block a back flow of the bill. Therefore, a fraudulent activity to retrieve a bill by pulling a string or a tape attached to the bill out of the validator after vending goods or services would be blocked by the blocking of anti-stringing block 9.

Though such a known art as anti-stringing block 9 is an effective measure against fraudulence using bills only, but a perfect measure has been difficult for other fraudulence to retrieve bills once validated as authentic out of validator with small materials of metal or paper used together with the strings to lift anti-stringing block 9 from the pathway except an introduction of a path blocking apparatus at the end of bill validator that can guarantee to block the return of the bill.

U.S. Pat. No. 4,513,439 discloses an example of path blocking apparatus for such purposes in which approximately drum shaped body having a rectangular slot for passing bill is rotated to prevent bill from being retrieved. But the problem is that the validator including the drum shaped body becomes large and the power consumed in the driving apparatus increases.

SUMMARY OF THE INVENTION

The bill validator disclosed comprises: (a) a bill inlet; (b) a pathway coupled to the inlet; (c) transportation portion and validation portion disposed on the pathway; (d) an outlet provided at one end of the pathway; and (e) a plurality of pathway selectors positioned nearer to the inlet than one of the transportation portion, wherein the plurality of selectors select the pathways in respective different phases for pathways to form a cross between the plurality of pathway selectors in every pathway selection.

BRIEF DESCRIPTION OF THE DRAWINGS

FIGS. 7A1 to 7A4, and 7B1 to 7B4 show schematic views of the rotating motion of the blocking gates of the bill validator of FIG. 1.

FIGS. 8C1 to 8C3 show schematic views of counter measure for fraudulent activity of the bill validator of FIG. 1.

DETAILED DESCRIPTION OF THE INVENTION (Exemplary Embodiment)

Now, the exemplary embodiment of the present invention is described with reference to the drawings.

Figure 1:
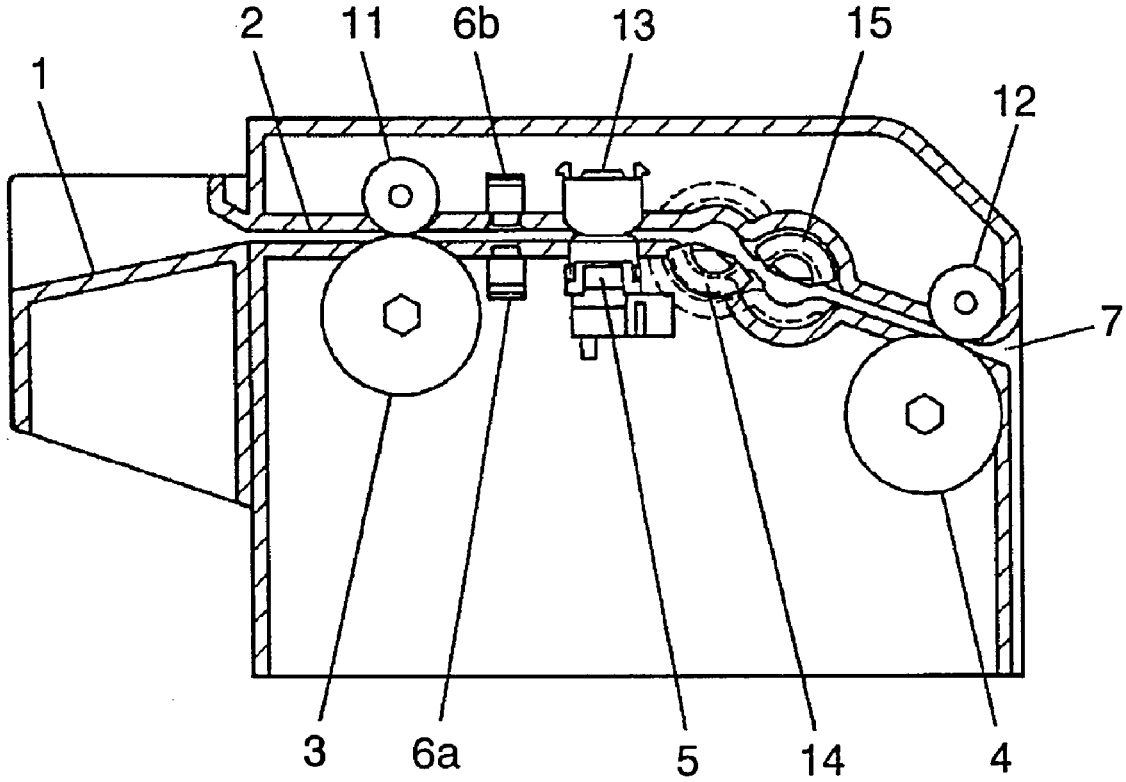
FIG. 1 shows a cross-sectional side view of a bill validator used in the exemplary embodiment of the present invention.

FIG. 1 shows a cross-sectional view of a pathway of the bill validator used in the exemplary embodiment of the present invention. Bill inlet 1 is coupled to pathway 2 provided with first transportation portion 3 and second transportation portion 4 as shown in FIG. 1. Rubber rollers accompanied by auxiliary rollers 11 and 12 respectively, facing each other across pathway 2 to press a bill between them are adopted as the transportation means in this example. Additionally, validation means comprised of magnetic sensor 5 with bill pressing member 13 and first optical sensors 6*a* and 6*b* are disposed in pathway 2.

Outlet 7 is located at an end of pathway 2 that extends to a bill storage box. Laid down across pathway 2, approximately semi-cylindrical shaped first blocking gate 14 and second blocking gate 15, a plurality of pathway selectors are disposed in a concaved portion that copies the shape of the periphery in pathway 2 between bill validation portion 5, 6*a*, 6*b* and transportation portion 4.

Figure 2:
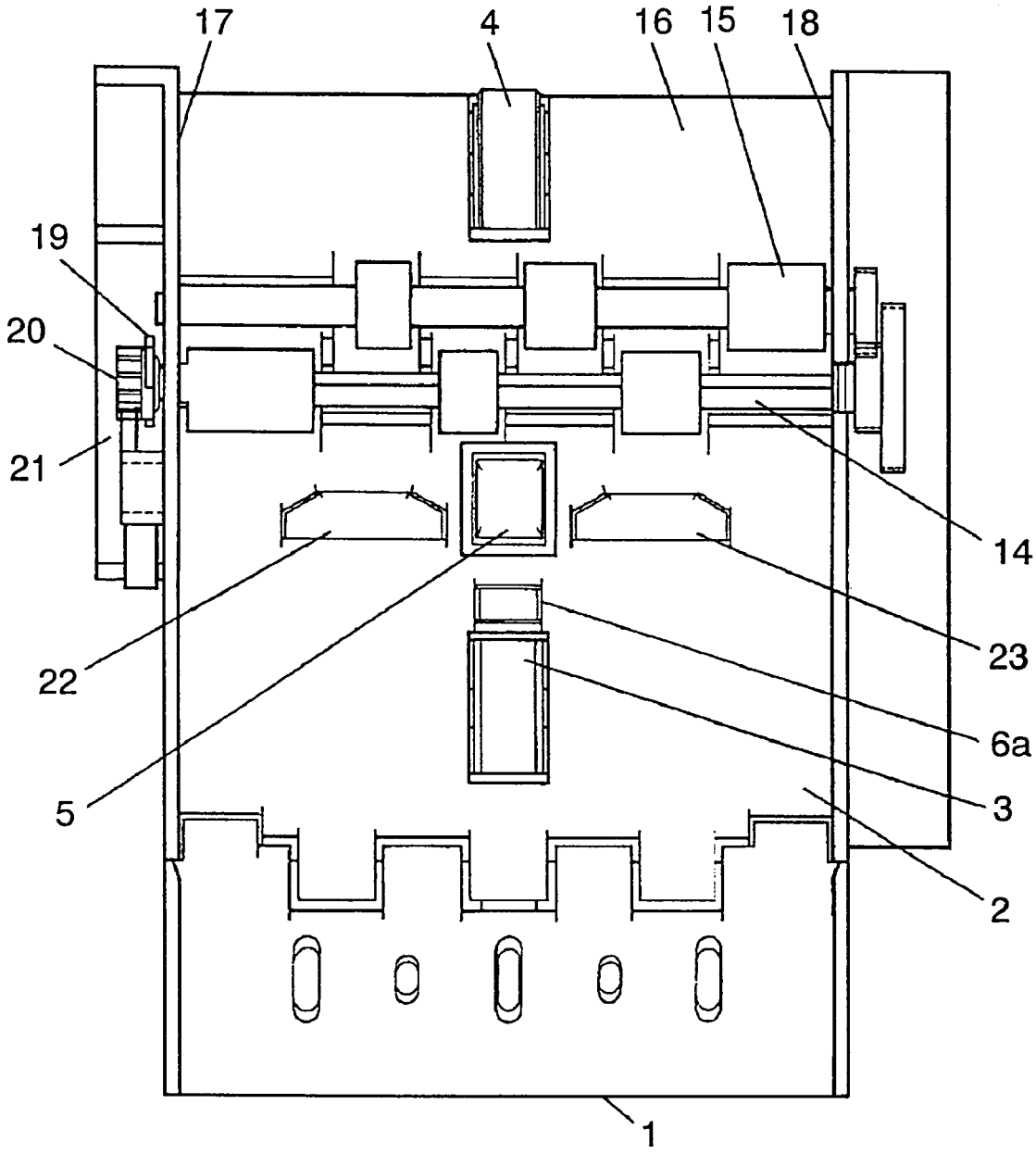
FIG. 2 shows a cross-sectional top view of the bill validator of FIG. 1.

FIG. 2 shows a top view of an internal structure of pathway 2 of the bill validator used in the exemplary embodiment. Both of first blocking gate 14 and second blocking gate 15 are formed across entire width of pathway 2 and are secured rotatably to side walls 17 and 18 of housing 16 that constructs pathway 2.

On one end of first blocking gate 14, vane wheel 19 is disposed that is necessary to detect a required rotation angle using an optical sensor (not shown), and ratchet 20 and click 21 are also disposed to control the rotation direction of rotary shutter.

Second optical sensor 22 and third optical sensor 23, added to validate a bill more precisely, are shown in FIG. 2 additionally.

Figure 3:
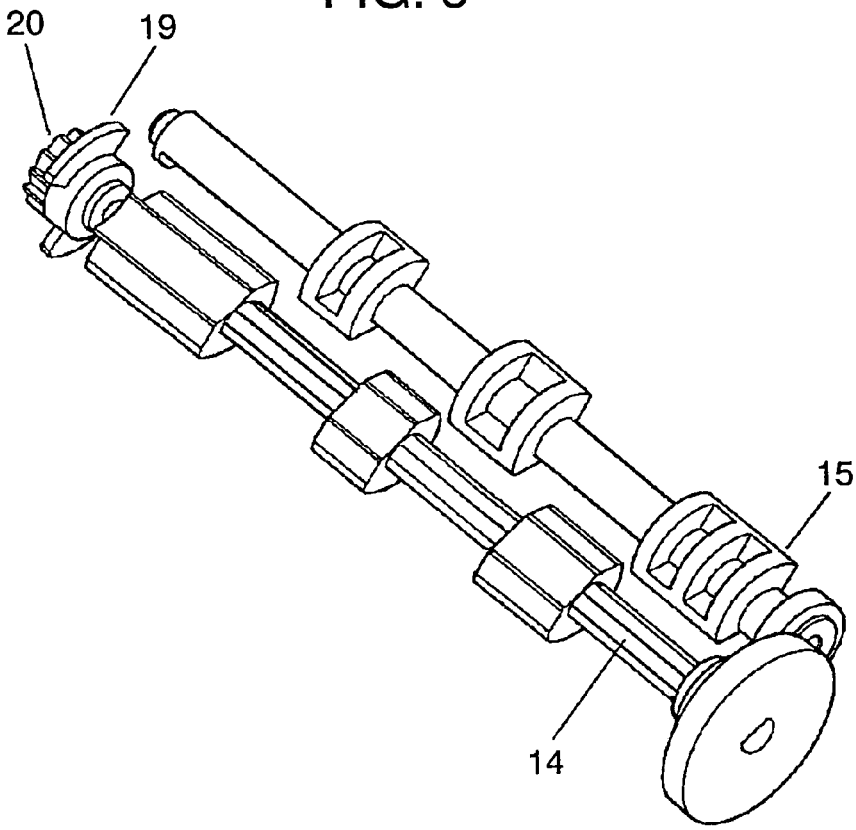
FIG. 3 shows a perspective view of blocking gates of the bill validator of FIG. 1.

FIG. 3 shows a perspective view of a relation between first blocking gate 14 and second blocking gate 15.

Figure 4:
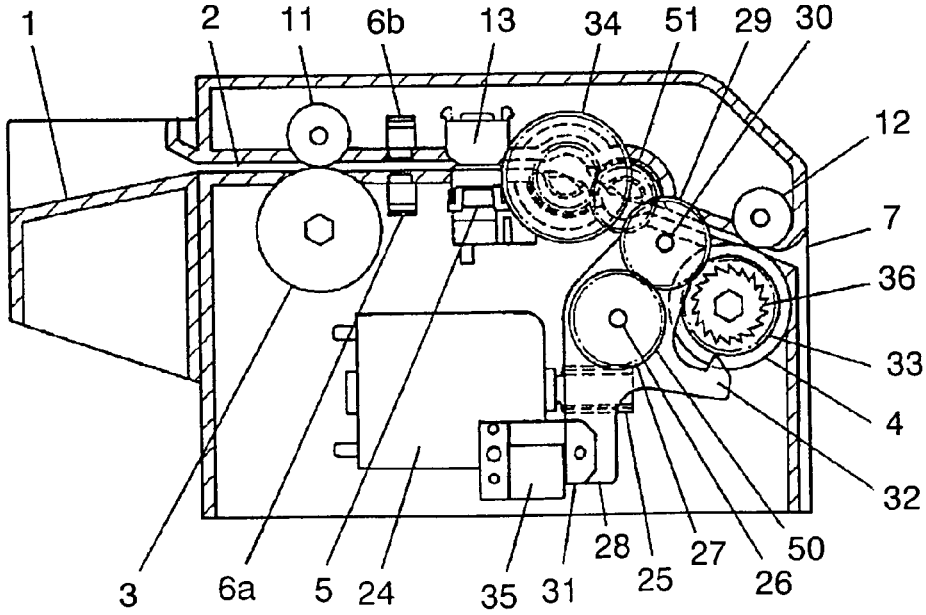
FIG. 4 shows a schematic view of the transportation mechanism of the driving portion of the bill validator of FIG. 1.

FIG. 4 shows a driving portion for first blocking gate 14 and second blocking gate 15. Worm 25 is fitted to rotary shaft of motor 24, and is geared to worm wheel 27 disposed on driving shaft 26 as shown in FIG. 4. Driving gear wheel 50 is fixed to driving shaft 26 concentrically, and crank arm 28 is also disposed on the shaft rotatably with a small axial friction.

Shaft 30 of planet gear wheel 29, moving iron 31 and roller lock 32 are fixed to crank arm 28 integrally. Planet gear wheel 29, usually engaged with driving gear 50, changes target to engage in response to a positioning of crank arm 28. Namely, in the first positioning corresponding to a clockwise movement of crank arm 28, planet gear wheel 29 engages with transportation driving gear 33 that rotates second transportation portion 4 at the same time. And in the second positioning corresponding to an anti-clockwise movement of crank arm 28 shown in FIG. 5, planet gear wheel 29 engages with two-stage gear 34 disposed on first blocking gate 14 concentrically. Two-stage gear 34 engages also gear 51 disposed on second blocking gate 15 concentrically enabling to rotate first blocking gate 14 and second blocking gate 15 synchronously.

Figure 5:
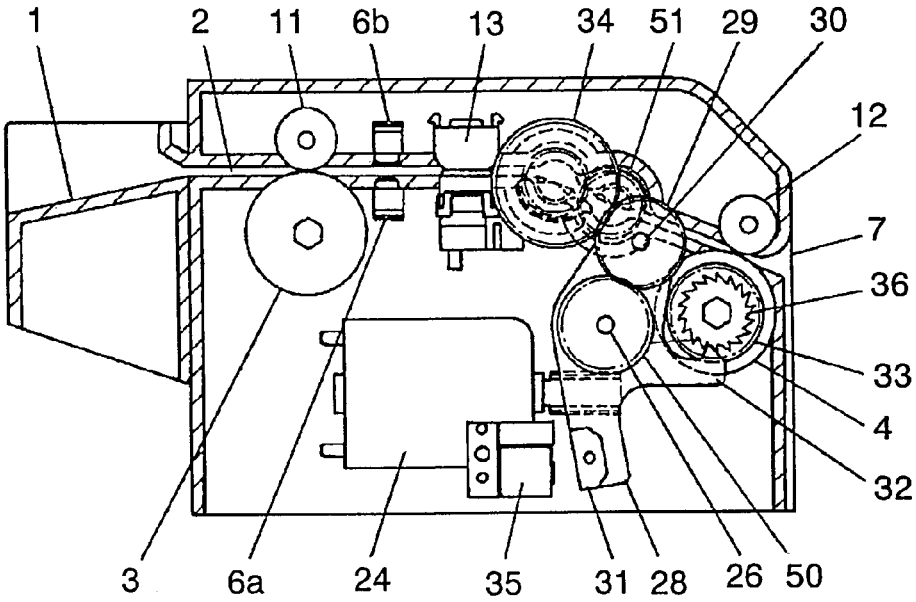
FIG. 5 shows a schematic view of the selecting mechanism of the driving portion of the bill validator of FIG. 1.

Moving iron 31 is appressed against absorption magnet 35 in the first positioning of crank arm 28. As shown in FIG. 5, in the second positioning of crank arm 28, roller lock 32 engages with gear 36 that is incorporated with second transportation portion 4 and transportation driving gear 33 to hold second transportation portion 4.

Figure 6:
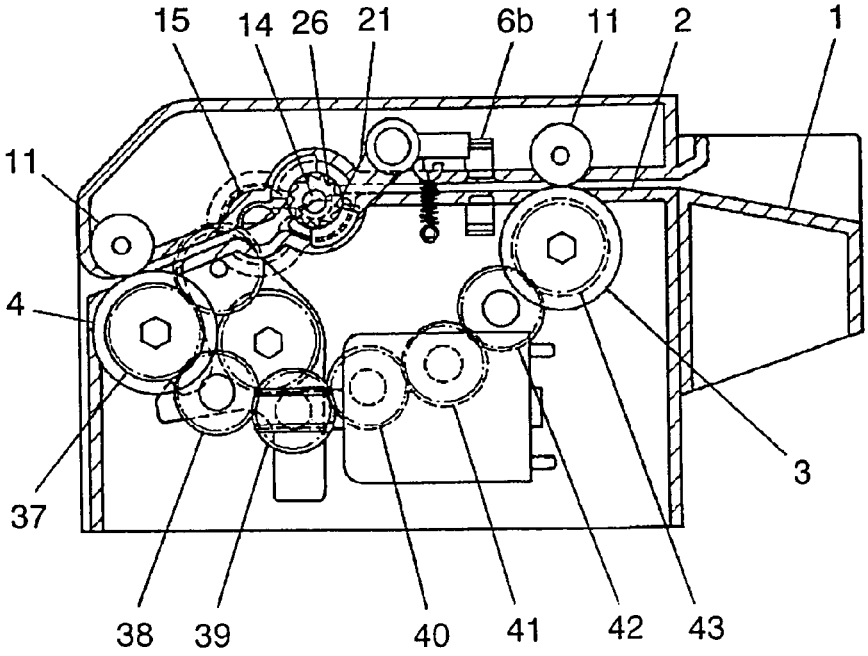
FIG. 6 shows a schematic view of the driving mechanism of the transportation portion of the bill validator of FIG. 1.
Figure 9:
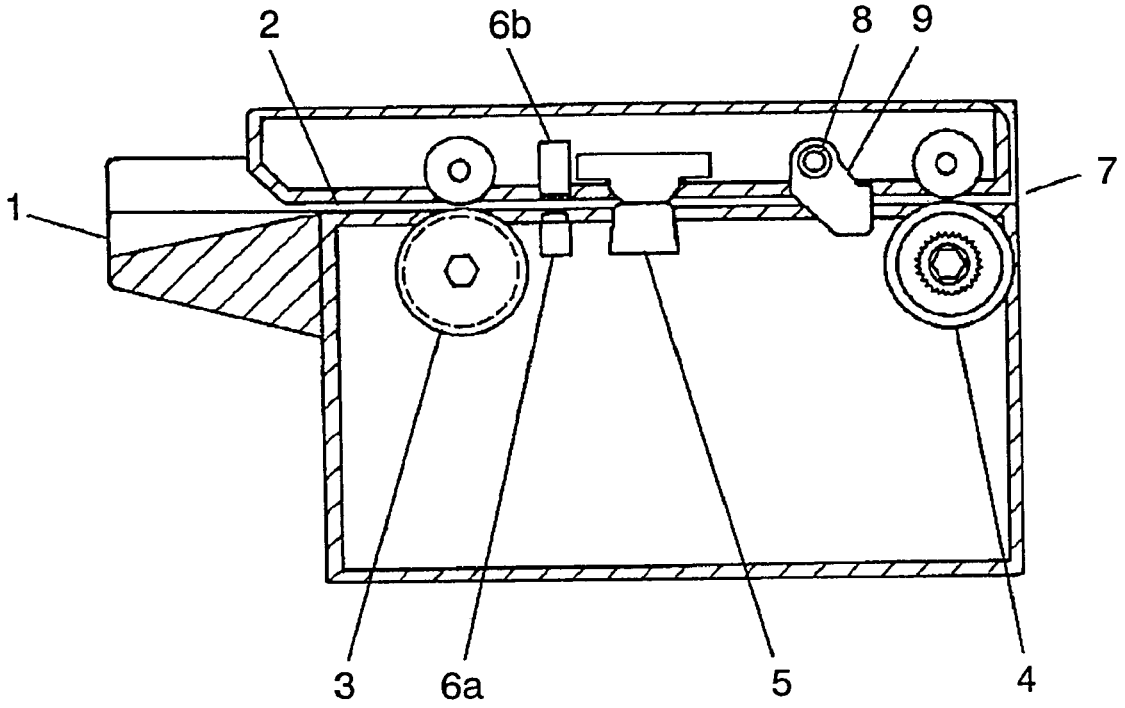
FIG. 9 PRIOR ART
FIG. 9 shows a cross-sectional side view of a conventional bill validator.

As shown in FIG. 6, second transportation portion 4 and first transportation portion 3 are engaged with a chain of gears 37, 38, 39, 40, 41, 41 and 43 to rotate simultaneously in the same direction.

Now, the movements of the bill validator used in the exemplary embodiment are described. As shown in FIG. 4, a bill detector (not shown) disposed at inlet 1 detects a bill inserting, and sends signals to controller (not shown) to drive motor 24 and to rotate driving shaft 26 clockwise. At the same time, absorption magnet 35 is energized to absorb moving iron 31 and to fix crank arm 28 in the first positioning.

Consequently, the second transportation portion 4 and first transportation portion 3 engaged in a chain of gears 37, 38, 39, 40, 41, 42 and 43 begin to rotate clockwise to pull the bill from inlet 1 to pathway 2.

Scanned by magnetic sensor 5 and first optical sensor 6*a* and 6*b* or the like, the bill is stopped traveling when a bill positioning sensor (not shown) or a bill travel distance detector judges that the rear edge of the bill passes second blocking gate 15 and stops the motor temporarily. If the data obtained from these sensors do not agree with a predetermined range of data from valid bills, motor 24 rotates in a reverse direction, leaving magnet 35 kept energized, to rotate second transportation portion 4 and first transportation portion 3 in anti-clockwise direction to emit the bill from inlet to outside.

If the data agree with a predetermined range of valid bills, power supply is switched off for magnet 35 to rotate motor 24 in a reverse direction. Then, crank arm 28 rotates anti-clockwise led by the rotating force of driving shaft 26 and moves to the second positioning as shown in FIG. 5. At this time, roller lock 32 locks gear 36, second transportation portion 4 that rotates with gear 36 simultaneously and first transportation portion 3 to stop the bill not to move anymore.

In the second positioning of crank arm 28, rotation of driving shaft 26 makes two-stage gear 34 rotate anti-clockwise, furthermore, makes first blocking gate 14 rotate anti-clockwise and make second blocking gate 15 rotate anti-clockwise. FIGS. 7A1 to 7B4 show conditions of the rotation control. Care should be taken that each element seems to rotate in an opposite direction to FIG. 5 due to the projection direction condition. Optical sensor comprised of vane wheel 19 and photo-interrupter 44 can control starting and stopping of first blocking gate 14 in timing with light shielding or lighting.

FIGS. 7B1, 7B2, 7B3 and 7B4 show positioning of vane wheels with respect to starting and stopping in steps of 90 degree. FIGS. 7A1, 7A2, 7A3 and 7A4 show respective corresponding conditions of opening and closing for the pathway by first blocking gate 14 and second blocking gate 15.

In addition to the control of rotating movements, ratchet 20 and click 21 can stop vane wheel at any position with accurately predetermined angle and can prevent rotation in a reverse direction caused by a pulling force from string or tape attached to the bill.

Rotating first blocking gate 14 and second blocking gate 15 by 90 degree as shown in FIG. 7A2, pathway 2 is perfectly closed to block fraudulent activities done by foreign materials inserted from inlet 1. If first blocking gate 14 and second blocking gate 15 do not rotate for a predetermined angle due to foreign materials engaged, vane wheel 19 and optical sensors will detect the fact and then cautions the occurrence of fraudulent activities.

After first blocking gate 14 and second blocking gate 15 properly close pathway 2, signal is processed subsequently to accept the bill as a valid bill, and absorption magnet 35 is energized again to drive motor 24 in normal direction to transport the bill to forward to the storage box.

Additionally, in case of need for the bill to be returned for a reason of machinery maintenance or the like even after accepting the bill as authentic, the bill can be emitted from inlet 1 to outside if absorption magnet 35 is energized to rotate motor 24 in a reverse direction because pathway 2 opens when first blocking gate 14 and second blocking gate 15 rotate by 90 degree to the stage as shown in FIG. 7A3. The present invention can contribute to increase a freedom in machine designing as such a function is impossible in conventional technology.

As described above, four times of sequential rotating operations in steps of 90 degree each can bring back to the initial situation. A fraudulent action to fool the bill validator may be predicted possible using a string fine enough not to disturb the movement of blocking gates and afterward retrieve the bill by pulling the string. As shown in FIG. 8C3, however, a fine string 52 inserted into pathway 2 would become an obstacle for bills or foreign materials coming into the path afterward, then the fraudulent activity is detected and will be thwarted.

As first blocking gate 14 and second blocking gate 15 have cylindrical periphery of a plurality of different shapes as shown in FIG. 3, comb-shaped joint configuration can prevent joint portion from pathway 2 to first blocking gate 14 or second blocking gate 15 from jamming with curled edges or fold lines of bills.

Additionally, a driving method for a plurality of pathway selectors using different power for the transportation portion is described in the exemplary embodiment of the invention. But briefly speaking, a different power for instance a ratchet apparatus driven by a solenoid can work also for the purpose. In this occasion, ratchet 20 and click 21 provided for positioning and anti-reverse rotation can be used commonly as a part of driving portion.

In accordance with an aspect of this invention, the bill validator has a plurality of pathway selectors comprised of a pair of approximately semi-cylindrical shaped blocking gates laid down across the pathway and a driving portion to rotate the pair of blocking gates around axes synchronously for opening and closing the path. The configuration can contribute to make the apparatus with low profile and to provide blocking gates with light weight resulting a reduced power consumption for the driving.

In accordance with also an aspect of this invention, the bill validator has a pair of blocking gates disposed such that the cross-sectional surfaces of the blocking gates are positioned to form a rotational symmetry with each other. The configuration has an effect to reduce the production cost of the validator by adopting blocking gates with same shapes for common use.

In accordance with also an aspect of this invention, the bill validator has blocking gates having cylindrical periphery of a plurality of different shapes and concaved portions having shapes copying the cylindrical periphery in the pathway to dispose the blocking gate. The configuration can prevent the comb-shaped joint portion from jamming with bills.

In accordance with another aspect of this invention, the bill validator has a pair of blocking gates disposed such that the maximum peripheral surface of one blocking gate faces against the minimum peripheral surface of another blocking gate. The configuration can prevent joint portions of both blocking gates from jamming with bills and can dispose blocking gates within a close distance resulting a downsizing design of the validator.

In accordance with another aspect of this invention, the bill validator is provided with a driving portion to restrict the rotation of the blocking gates in one direction only. The configuration can prevent bills from being retrieved from the validator by a strong pulling force through a string or the like attached to the bill that makes blocking gates rotate in a reverse direction and eventually open the pathway.

In accordance with also an aspect of this invention, the bill validator is provided with a canceling portion to cancel the function of the driving portion temporarily to rotate blocking gates freely in both directions. The configuration enables for administrators to clear off the foreign materials engaged in the blocking gates if a fraudulent activity is deterred leaving strings or bills or the like left engaged in the blocking gates.

In accordance with also an aspect of this invention, the bill validator has: a driving base; a gear clutch coupled to the driving base; an electric magnet to restrict a movement of the clutch in one direction only, wherein the transportation portion is coupled to one driving shaft to which gear clutch is coupled when the magnet is energized and the other driving shaft is to work as a driving portion of a blocking gates. The configuration can provide a bill validator having "anti-stringing" structure with a downsized body and reduced price as the driving base specifically for use in the blocking gates is not necessary.

In accordance with also an aspect of this invention, the bill validator is provided with a hook wheel on the rotary shaft coupled to the transportation portion, wherein a stopper to restrict the transportation portion by engaging with hook wheel, when the gear clutch is engaged in the other rotary shaft, is incorporated with the gear clutch. The configuration has an effect to eliminate risks that movement of bills can not be controlled under out-of-control movement of the transportation portion, even in a case when the power supply is changed by the gear clutch.

In accordance with also an aspect of this invention, the bill validator employs a ratchet mechanism driven by a solenoid as the driving portion, wherein the ratchet mechanism works also as a control portion. The configuration can provide a simple and reliable driving portion for the blocking gates.

In accordance also with an aspect of this invention, the bill validator has a plurality of pathway selectors having a pair of gate plates across the width of the pathway in a direction of bill thickness. The configuration can provide reliable pathway selectors if rotary blocking gates are difficult to apply owing to some restrictive condition of the pathway design.

Additionally, different from the rotary blocking gates used in the exemplary embodiment, among pathway selectors performing various types of motion in the pathway such as oscillating motion or reciprocating motion, combination of more than two types of pathway selectors in different phases of motion can provide a reliable anti-fraudulence effects as shown in FIGS. 8C1, 8C2 and 8C3.

The above mentioned configurations can provide bill validators with a reliable anti-retrieving effects.

As mentioned above, the bill validator disclosed in the present invention is provided with a plurality of pathway selectors at a position nearer to the inlet from the outlet, wherein the selectors select the pathways in respective different phases for the pathways to form a cross between the plurality of pathway selectors in every pathway selection. The configuration can prevent accepted bills from being retrieved using strings or tapes.

What is claimed is:

1. A bill validator comprising:

(a) a bill inlet; (b) a pathway coupled to said inlet; (c) a transportation portion and a validation portion provided in said pathway; (d) an outlet provided at one end of said pathway; and (e) a plurality of pathway selectors provided at a position nearer to said inlet than one of said transportation portion, wherein said plurality of selectors select said pathways in respective different phases for said pathways to form blocking between said plurality of pathway selectors in every pathway selection.

2. The bill validator of claim 1, wherein said plurality of pathway selectors comprise a pair of approximately semi-cylindrical shaped blocking gates laid down across said pathway and a driving portion to rotate said pair of blocking gates around axes synchronously for opening and closing said pathway.

3. The bill validator of claim 2, wherein said pair of blocking gates is disposed such that cross-sectional surfaces of said blocking gates are positioned to form a rotational symmetry with each other.

4. The bill validator of claim 2, wherein cylindrical periphery of said blocking gates have a plurality of different cylindrical shapes and concaved portions in said pathway to dispose said blocking gates are formed copying said cylindrical periphery.

5. The bill validator of claim 4, wherein said pair of blocking gates is disposed such that the maximum peripheral surface of one of said blocking gates faces against the minimum peripheral surface of another of said blocking gates.

6. The bill validator of claim 2, further comprising a controlling portion to restrict rotation of said blocking gates in one direction only.

7. The bill validator of claim 6, further comprising a canceling portion to cancel functions of said controlling portion temporarily to rotate said blocking gates freely in both directions.

8. The bill validator of claim 2, further comprising: a driving base; a gear clutch coupled to said driving base; and an electrical magnet to restrict movements of said gear clutch in one direction only, wherein the transportation portion is coupled to one driving shaft to which said gear clutch is coupled when said electrical magnet is energized and the other driving shaft is to work as a driving portion for said blocking gates.

9. The bill validator of claim 8, further comprising a hook wheel on a driving shaft coupled to said transportation portion, wherein a stopper to restrict said transportation portion by engaging with said hook wheel, when said gear clutch is engaged in the other driving shaft, is incorporated with said gear clutch.

10. The bill validator of claim 6, wherein a ratchet mechanism driven by a solenoid is employed as said driving portion, and said ratchet mechanism works also as a control portion.

11. The bill validator of claim 1, wherein said plurality of pathway selectors has a pair of gate plates across said pathway in a direction of said bill thickness.

* * * * *